US011749905B2

(12) United States Patent
Cheng et al.

(10) Patent No.: US 11,749,905 B2
(45) Date of Patent: Sep. 5, 2023

(54) DUAL-BAND PATCH ARRAY ANTENNA MODULE AND ELECTRONIC DEVICE USING THE SAME

(71) Applicant: Taiwan Inpaq electronic Co., Ltd., Miaoli County (TW)

(72) Inventors: Ta-Fu Cheng, Miaoli County (TW); Cheng-Yi Wang, New Taipei (TW); Ting-Wei Lin, Tainan (TW)

(73) Assignee: Taiwan Inpaq electronic Co., Ltd., Miaoli County (TW)

( * ) Notice: Subject to any disclaimer, the term of this patent is extended or adjusted under 35 U.S.C. 154(b) by 102 days.

(21) Appl. No.: 17/568,673

(22) Filed: Jan. 4, 2022

(65) Prior Publication Data

US 2023/0116495 A1 Apr. 13, 2023

(30) Foreign Application Priority Data

Oct. 8, 2021 (TW) ..... 110137426

(51) Int. Cl.

| | |
|---|---|
| ***H01Q 21/06*** | (2006.01) |
| ***H01Q 1/38*** | (2006.01) |
| ***H01Q 1/52*** | (2006.01) |
| ***H01Q 9/04*** | (2006.01) |

(52) U.S. Cl.

CPC ..... *H01Q 21/065* (2013.01); *H01Q 1/38* (2013.01); *H01Q 1/526* (2013.01); *H01Q 9/0414* (2013.01)

(58) Field of Classification Search

CPC ..... H01Q 21/065; H01Q 1/38; H01Q 1/526; H01Q 9/0414; H01Q 5/42; H01Q 9/0457; H01Q 21/08

See application file for complete search history.

(56) References Cited

U.S. PATENT DOCUMENTS

| | | | | |
|---|---|---|---|---|
| 10,483,621 | B2 * | 11/2019 | Rashidian | H01Q 5/385 |
| 2017/0256867 | A1 * | 9/2017 | Ding | H01Q 15/14 |

* cited by examiner

*Primary Examiner* — David E Lotter

(74) *Attorney, Agent, or Firm* — Li & Cai Intellectual Property Office

(57) ABSTRACT

A dual-band patch array antenna module and an electronic device using the same are provided. The dual-band patch array antenna module includes an insulative carrier substrate, a common conductive metal layer, a common grounding metal layer, an outer surrounding shielding structure, a plurality of first band antenna structures, and a plurality of second band antenna structures. The common conductive metal layer is disposed inside the insulative carrier substrate. The common grounding metal layer is disposed on the insulative carrier substrate. The outer surrounding shielding structure is electrically connected between the common conductive metal layer and the common grounding metal layer. Each first band antenna structure includes a first radiator, two first metal elements, two first feeding elements, and two first inner surrounding shielding assemblies. Each second band antenna structure includes a second radiator, two second metal elements, two second feeding elements, and two second inner surrounding shielding assemblies.

10 Claims, 12 Drawing Sheets

DUAL-BAND PATCH ARRAY ANTENNA MODULE AND ELECTRONIC DEVICE USING THE SAME

CROSS-REFERENCE TO RELATED PATENT APPLICATION

This application claims the benefit of priority to Taiwan Patent Application No. 110137426, filed on Oct. 8, 2021. The entire content of the above identified application is incorporated herein by reference.

Some references, which may include patents, patent applications and various publications, may be cited and discussed in the description of this disclosure. The citation and/or discussion of such references is provided merely to clarify the description of the present disclosure and is not an admission that any such reference is "prior art" to the disclosure described herein. All references cited and discussed in this specification are incorporated herein by reference in their entireties and to the same extent as if each reference was individually incorporated by reference.

FIELD OF THE DISCLOSURE

The present disclosure relates to an antenna module, and more particularly to a dual-band patch array antenna module and an electronic device using the dual-band patch array antenna module.

BACKGROUND OF THE DISCLOSURE

In the related art, all conventional patch antenna modules are formed by stacked antenna structures, so that the conventional patch antenna module still has room for improvement.

SUMMARY OF THE DISCLOSURE

In response to the above-referenced technical inadequacy, the present disclosure provides a dual-band patch array antenna module and an electronic device using the same.

In one aspect, the present disclosure provides a dual-band patch array antenna module, which includes an insulative carrier substrate, a common conductive metal layer, a common grounding metal layer, an outer surrounding shielding structure, a plurality of first band antenna structures, and a plurality of second band antenna structures. The common conductive metal layer is disposed inside the insulative carrier substrate, and the common conductive metal layer has a plurality of first through openings and a plurality of second through openings. The common grounding metal layer is disposed on a bottom side of the insulative carrier substrate. The outer surrounding shielding structure is electrically connected between the common conductive metal layer and the common grounding metal layer. Each of the first band antenna structures includes a first radiator, two first metal elements, two first feeding elements, and two first inner surrounding shielding assemblies, the first radiator is disposed on the insulative carrier substrate, the two first metal elements are disposed on the insulative carrier substrate and adjacent to the first radiator, the two first feeding elements pass through the insulative carrier substrate and respectively electrically connect to the two first metal elements, and the two first inner surrounding shielding assemblies are disposed inside the insulative carrier substrate and respectively surround the two first feeding elements. Each of the second band antenna structures includes a second radiator, two second metal elements, two second feeding elements, and two second inner surrounding shielding assemblies, the second radiator is disposed on the insulative carrier substrate, the two second metal elements are disposed on the insulative carrier substrate and adjacent to the second radiator, the two second feeding elements pass through the insulative carrier substrate and respectively electrically connect to the two second metal elements, and the two second inner surrounding shielding assemblies are disposed inside the insulative carrier substrate and respectively surround the two second feeding elements.

More particularly, each of the first feeding elements is disposed between a corresponding one of the first metal elements and the common grounding metal layer, and separated from the common grounding metal layer through a first insulative ring, and each of the second feeding elements is disposed between a corresponding one of the second metal elements and the common grounding metal layer, and separated from the common grounding metal layer through a second insulative ring. Each of the first inner surrounding shielding assemblies includes a first annular connecting element and a plurality of first inner shielding connecting elements, the first annular connecting element is electrically connected to the common conductive metal layer and surrounds a corresponding one of the first feeding elements, and the first inner shielding connecting elements are electrically connected between the first annular connecting element and the common grounding metal layer, and surround the corresponding one of the first feeding elements. Each of the second inner surrounding shielding assemblies includes a second annular connecting element and a plurality of second inner shielding connecting elements, the second annular connecting element is electrically connected to the common conductive metal layer and surrounds a corresponding one of the second feeding elements, and the second inner shielding connecting elements are electrically connected between the second annular connecting element and the common grounding metal layer, and surround the corresponding one of the second feeding elements. The two first feeding elements of each of the first band antenna structures and the first inner shielding connecting elements respectively pass through the first through openings, and the two second feeding elements of each of the second band antenna structures and the second inner shielding connecting elements respectively pass through the second through openings.

In another aspect, the present disclosure provides a dual-band patch array antenna module, which includes an insulative carrier substrate, a common conductive metal layer, a common grounding metal layer, an outer surrounding shielding structure, a plurality of first band antenna structures, and a plurality of second band antenna structures. The common conductive metal layer is disposed inside the insulative carrier substrate. The common grounding metal layer is disposed on a bottom side of the insulative carrier substrate. The outer surrounding shielding structure is electrically connected between the common conductive metal layer and the common grounding metal layer. Each of the first band antenna structures includes a first radiator disposed on the insulative carrier substrate, two first metal elements adjacent to the first radiator, two first feeding elements respectively electrically connected to the two first metal elements, and two first inner surrounding shielding assemblies respectively surrounding the two first feeding elements. Each of the second band antenna structures includes a second radiator disposed on the insulative carrier substrate, two second metal elements adjacent to the second radiator, two second feeding elements respectively electrically connected to the two second metal elements, and two second inner surrounding shielding assemblies respectively surrounding the two second feeding elements.

In yet another aspect, the present disclosure provides an electronic device using a dual-band patch array antenna module, and the dual-band patch array antenna module includes an insulative carrier substrate, a common conductive metal layer, a common grounding metal layer, an outer surrounding shielding structure, a plurality of first band antenna structures, and a plurality of second band antenna structures. The common conductive metal layer is disposed inside the insulative carrier substrate. The common grounding metal layer is disposed on a bottom side of the insulative carrier substrate. The outer surrounding shielding structure is electrically connected between the common conductive metal layer and the common grounding metal layer. Each of the first band antenna structures includes a first radiator disposed on the insulative carrier substrate, two first metal elements adjacent to the first radiator, two first feeding elements respectively electrically connected to the two first metal elements, and two first inner surrounding shielding assemblies respectively surrounding the two first feeding elements. Each of the second band antenna structures includes a second radiator disposed on the insulative carrier substrate, two second metal elements adjacent to the second radiator, two second feeding elements respectively electrically connected to the two second metal elements, and two second inner surrounding shielding assemblies respectively surrounding the two second feeding elements.

Therefore, in the dual-band patch array antenna module and the electronic device provided by the present disclosure, by virtue of "the common conductive metal layer being disposed inside the insulative carrier substrate," "the common grounding metal layer being disposed on a bottom side of the insulative carrier substrate," "the outer surrounding shielding structure being electrically connected between the common conductive metal layer and the common grounding metal layer," "each of the first band antenna structures including a first radiator disposed on the insulative carrier substrate, two first metal elements adjacent to the first radiator, two first feeding elements respectively electrically connected to the two first metal elements, and two first inner surrounding shielding assemblies respectively surrounding the two first feeding elements," and "each of the second band antenna structures including a second radiator disposed on the insulative carrier substrate, two second metal elements adjacent to the second radiator, two second feeding elements respectively electrically connected to the two second metal elements, and two second inner surrounding shielding assemblies respectively surrounding the two second feeding elements," an antenna isolation between the first band antenna structure and the second band antenna structure can be improved, so that an antenna mode provided by the dual-band patch array antenna module can be cleared so as to obtain a clear antenna mode, and an antenna characteristic provided by the dual-band patch array antenna module can be improved so as to obtain an optimal antenna performance.

These and other aspects of the present disclosure will become apparent from the following description of the embodiment taken in conjunction with the following drawings and their captions, although variations and modifications therein may be affected without departing from the spirit and scope of the novel concepts of the disclosure.

BRIEF DESCRIPTION OF THE DRAWINGS

The described embodiments may be better understood by reference to the following description and the accompanying drawings, in which.

DETAILED DESCRIPTION OF THE EXEMPLARY EMBODIMENTS

Figure 1:
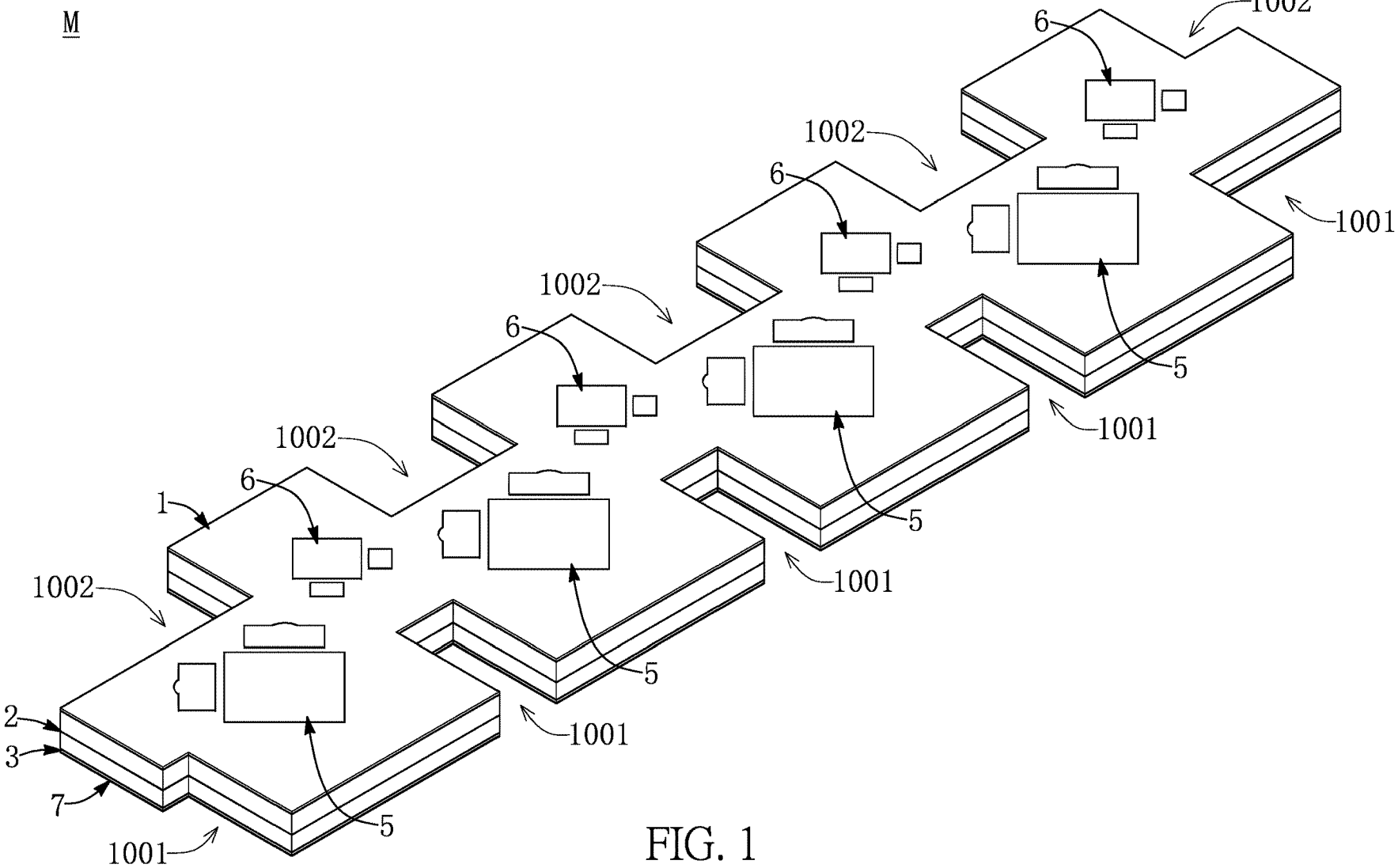
FIG. 1 is a schematic perspective view of a dual-band patch array antenna module according to a first embodiment of the present disclosure.

The present disclosure is more particularly described in the following examples that are intended as illustrative only since numerous modifications and variations therein will be apparent to those skilled in the art. Like numbers in the drawings indicate like components throughout the views. As used in the description herein and throughout the claims that follow, unless the context clearly dictates otherwise, the meaning of "a", "an", and "the" includes plural reference, and the meaning of "in" includes "in" and "on". Titles or subtitles can be used herein for the convenience of a reader, which shall have no influence on the scope of the present disclosure.

The terms used herein generally have their ordinary meanings in the art. In the case of conflict, the present document, including any definitions given herein, will prevail. The same thing can be expressed in more than one way.

Alternative language and synonyms can be used for any term(s) discussed herein, and no special significance is to be placed upon whether a term is elaborated or discussed herein. A recital of one or more synonyms does not exclude the use of other synonyms. The use of examples anywhere in this specification including examples of any terms is illustrative only, and in no way limits the scope and meaning of the present disclosure or of any exemplified term. Likewise, the present disclosure is not limited to various embodiments given herein. Numbering terms such as "first", "second" or "third" can be used to describe various components, signals or the like, which are for distinguishing one component/signal from another one only, and are not intended to, nor should be construed to impose any substantive limitations on the components, signals or the like.

Referring to FIG. 1 to FIG. 12, the present disclosure provides a dual-band patch array antenna module M and an electronic device P using the dual-band patch array antenna module M, and the dual-band patch array antenna module M includes an insulative carrier substrate 1, a common conductive metal layer 2, a common grounding metal layer 3, an outer surrounding shielding structure 4, a plurality of first band antenna structures 5, and a plurality of second band antenna structures 6. More particularly, the common conductive metal layer 2 is disposed inside the insulative carrier substrate 1, the common grounding metal layer 3 is disposed on a bottom side of the insulative carrier substrate 1, and the outer surrounding shielding structure 4 is electrically connected between the common conductive metal layer 2 and the common grounding metal layer 3. In addition, each of the first band antenna structures 5 includes a first radiator 51 disposed on the insulative carrier substrate 1, two first metal elements 52 adjacent to the first radiator 51, two first feeding elements 53 respectively electrically connected to the two first metal elements 52, and two first inner surrounding shielding assemblies respectively surrounding the two first feeding elements 53. Moreover, each of the second band antenna structures 6 includes a second radiator 61 disposed on the insulative carrier substrate 1, two second metal elements 62 adjacent to the second radiator 61, two second feeding elements 63 respectively electrically connected to the two second metal elements 62, and two second inner surrounding shielding assemblies respectively surrounding the two second feeding elements 63. Therefore, an antenna isolation between the first band antenna structure 5 and the second band antenna structure 6 can be improved by cooperation of the outer surrounding shielding structure 4, the two first inner surrounding shielding assemblies, and the two second inner surrounding shielding assemblies, so that an antenna mode provided by the dual-band patch array antenna module M can be cleared so as to obtain a clear antenna mode, and an antenna characteristic provided by the dual-band patch array antenna module M can be improved so as to obtain an optimal antenna performance.

First Embodiment

Referring to FIG. 1 to FIG. 9, a first embodiment of the present disclosure provides a dual-band patch array antenna module M, which includes an insulative carrier substrate 1, a common conductive metal layer 2, a common grounding metal layer 3, an outer surrounding shielding structure 4, a plurality of first band antenna structures 5, and a plurality of second band antenna structures 6. For example, the dual-band patch array antenna module M (or the dual-band panel array antenna module) can be applied to a millimeter wave channel or a millimeter wave frequency band such as between 28 GHz and 39 GHz. However, the aforementioned details are disclosed for exemplary purposes only, and are not meant to limit the scope of the present disclosure.

Figure 2:
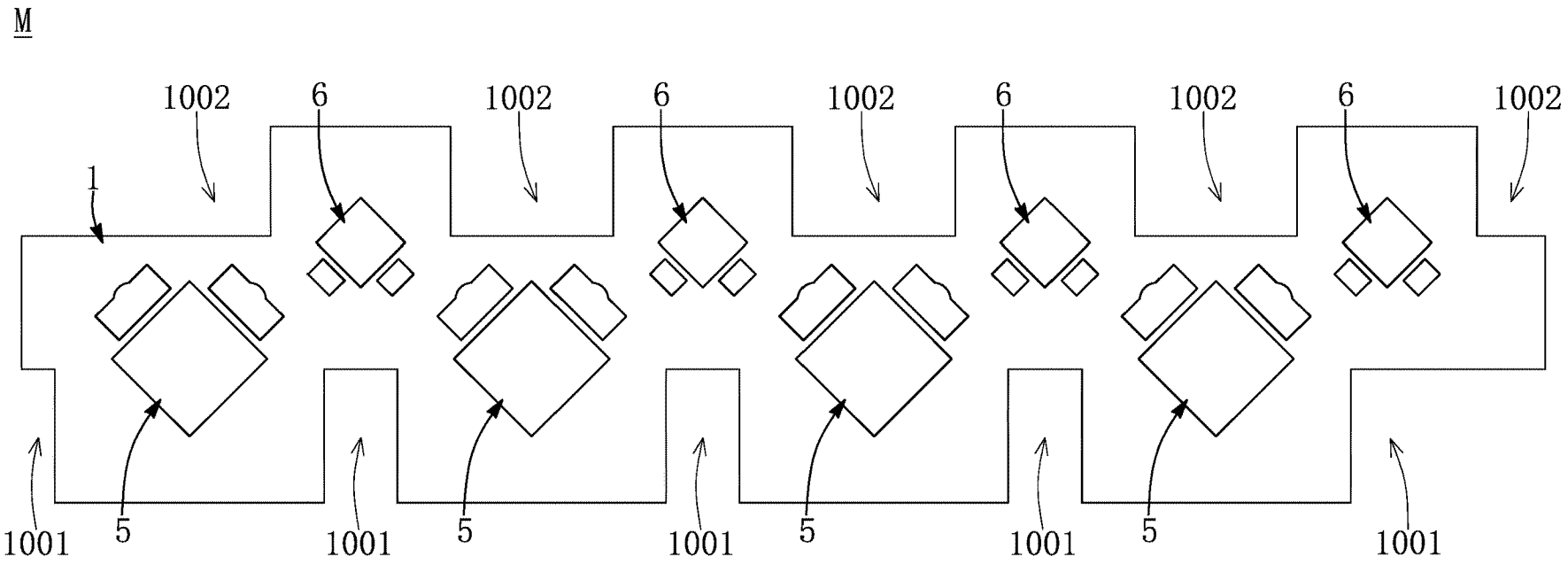
FIG. 2 is a schematic top view of the dual-band patch array antenna module according to the first embodiment of the present disclosure.

Firstly, referring to FIG. 1, FIG. 2, FIG. 3, FIG. 6 and FIG. 7, the common conductive metal layer 2 is disposed inside the insulative carrier substrate 1, and the common conductive metal layer 2 has a plurality of first through openings 201 (such as through holes) and a plurality of second through openings 202 (such as through holes). In addition, the common grounding metal layer 3 is disposed on a bottom side of the insulative carrier substrate 1, and the outer surrounding shielding structure 4 is electrically connected between the common conductive metal layer 2 and the common grounding metal layer 3. For example, the insulative carrier substrate 1 has a plurality of first notches 1001 and a plurality of second notches 1002. The first notches 1001 can be recessed from a first lateral side of the insulative carrier substrate 1 and respectively correspond to the second band antenna structures 6, and the second notches 1002 can be recessed from a second lateral side of the insulative carrier substrate 1 and respectively correspond to the first band antenna structures 5. In addition, the first band antenna structures 5 can be adjacent to the first lateral side of the insulative carrier substrate 1 and arranged in a straight line, the second band antenna structures 6 can be adjacent to the second lateral side of the insulative carrier substrate 1 and arranged in a straight line, and the first band antenna structures 5 and the second band antenna structures 6 can be staggered with respect to each other (as shown in FIG. 2). Moreover, the outer surrounding shielding structure 4 includes a plurality of outer shielding connecting elements 41 separate from each other and arranged in an annular shape, the outer shielding connecting elements 41 can surround the first band antenna structures 5 and the second band antenna structures 6, and each of the outer shielding connecting elements 41 can be electrically connected between the common conductive metal layer 2 and the common grounding metal layer 3. However, the aforementioned details are disclosed for exemplary purposes only, and are not meant to limit the scope of the present disclosure.

Moreover, referring to FIG. 4, FIG. 5, FIG. 6 and FIG. 8, each of the first band antenna structures 5 includes a first radiator 51, two first metal elements 52 (or another two first radiators), two first feeding elements 53, and two first inner surrounding shielding assemblies. More particularly, the first radiator 51 is disposed on the insulative carrier substrate 1, and the two first metal elements 52 are disposed on the insulative carrier substrate 1 and adjacent to the first radiator 51. In addition, the two first feeding elements 53 pass through the insulative carrier substrate 1 and respectively electrically connect to the two first metal elements 52, and each of the first feeding elements 53 is disposed between a corresponding one of the first metal elements 52 and the common grounding metal layer 3, and separated from the common grounding metal layer 3 through a first insulative ring R1. Moreover, the two first inner surrounding shielding assemblies are disposed inside the insulative carrier substrate 1 and respectively surround the two first feeding elements 53, and each of the first inner surrounding shielding assemblies includes a first annular connecting element 54 and a plurality of first inner shielding connecting elements 55. Furthermore, the first annular connecting element 54 is electrically connected to the common conductive metal layer 2 and surrounds a corresponding one of the first feeding elements 53, and the first inner shielding connecting elements 55 are electrically connected between the first annular connecting element 54 and the common grounding metal layer 3, and surround the corresponding one of the first feeding elements 53.

Furthermore, referring to FIG. 4, FIG. 5, FIG. 6 and FIG. 8, each of the second band antenna structures 6 includes a second radiator 61, two second metal elements 62 (or another two second radiators), two second feeding elements 63, and two second inner surrounding shielding assemblies. More particularly, the second radiator 61 is disposed on the insulative carrier substrate 1, and the two second metal elements 62 are disposed on the insulative carrier substrate 1 and adjacent to the second radiator 61. In addition, the two second feeding elements 63 pass through the insulative carrier substrate 1 and respectively electrically connect to the two second metal elements 62, and each of the second feeding elements 63 is disposed between a corresponding one of the second metal elements 62 and the common grounding metal layer 3, and separated from the common grounding metal layer 3 through a second insulative ring R2. Moreover, the two second inner surrounding shielding assemblies are disposed inside the insulative carrier substrate 1 and respectively surround the two second feeding elements 63, and each of the second inner surrounding shielding assemblies includes a second annular connecting element 64 and a plurality of second inner shielding connecting elements 65. Furthermore, the second annular connecting element 64 is electrically connected to the common conductive metal layer 2 and surrounds a corresponding one of the second feeding elements 63, and the second inner shielding connecting elements 65 are electrically connected between the second annular connecting element 64 and the common grounding metal layer 3, and surround the corresponding one of the second feeding elements 63.

Figure 5:
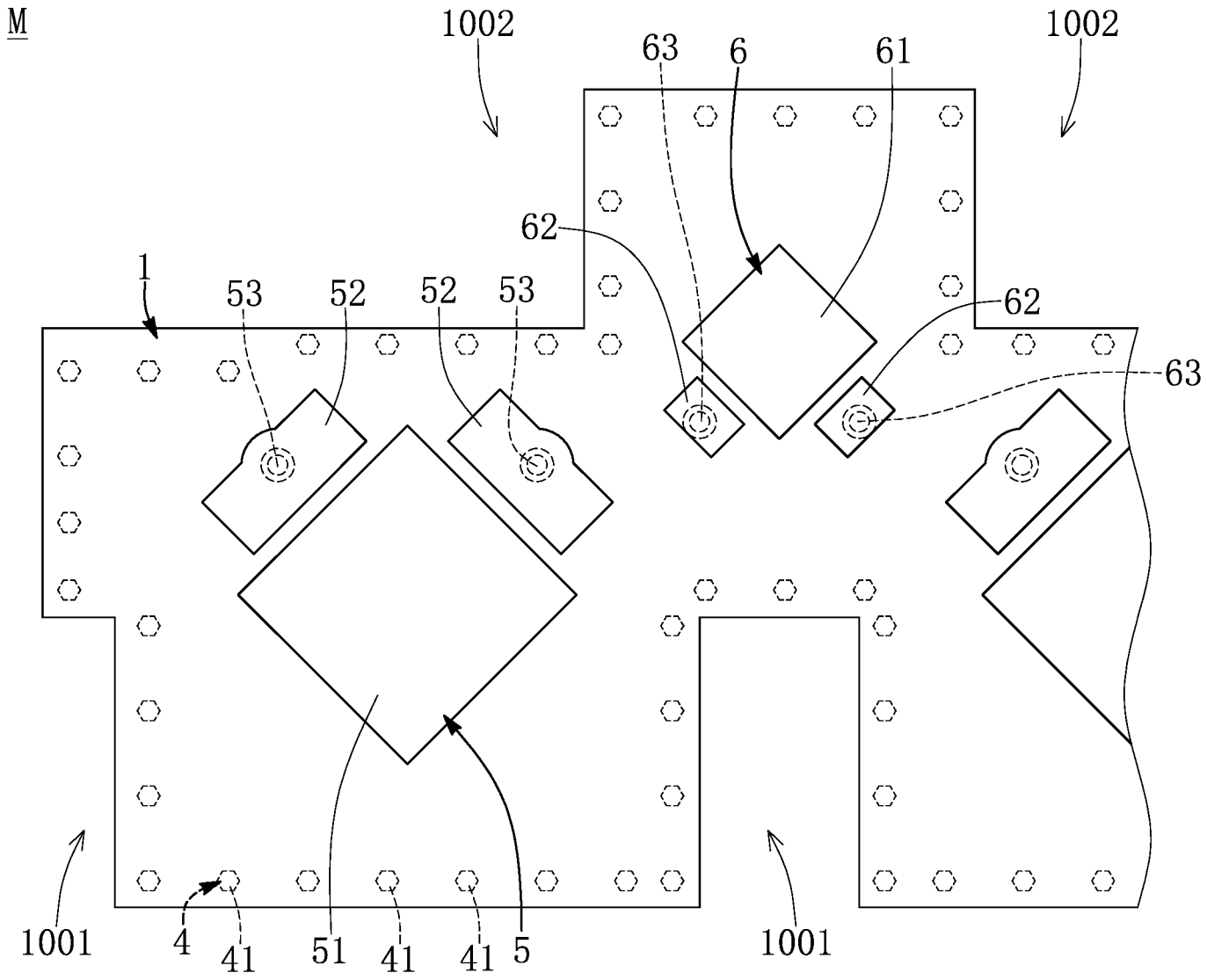
FIG. 5 is a partial schematic top view of the dual-band patch array antenna module according to the first embodiment of the present disclosure.
Figure 6:
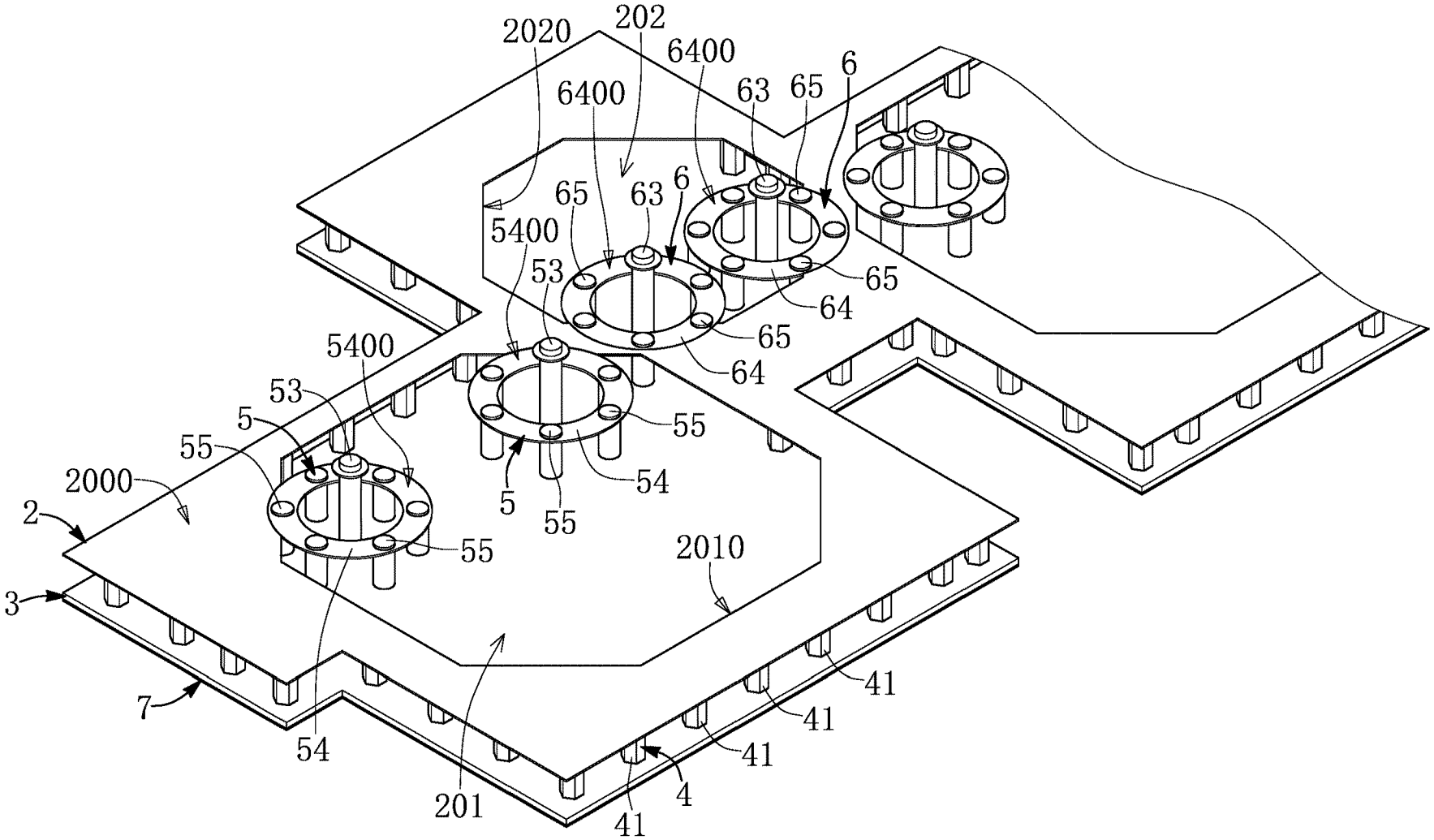
FIG. 6 is a partial schematic perspective view of the dual-band patch array antenna module after removing an insulative carrier substrate according to the first embodiment of the present disclosure.

For example, as shown in FIG. 6, the two first feeding elements 53 of each of the first band antenna structures 5 and the first inner shielding connecting elements 55 can concurrently and respectively pass through the first through openings 201, and the two second feeding elements 63 of each of the second band antenna structures 6 and the second inner shielding connecting elements 65 can concurrently and respectively pass through the second through openings 202. In addition, as shown in FIG. 6, the common conductive metal layer 2, the first annular connecting element 54 and the second annular connecting element 64 have a same thickness, and a top surface 2000 of the common conductive metal layer 2, a top surface 5400 of the first annular connecting element 54 and a top surface 6400 of the second annular connecting element 64 can be flush with each other. It should be noted that, referring to FIG. 5, FIG. 7 and FIG. 9, an outer contour (or outer profile) of the common conductive metal layer 2, an outer contour (or outer profile) of the common grounding metal layer 3, and an outer contour (or outer profile) of the insulative carrier substrate 1 can be the same or different. In addition, referring to FIG. 4 and FIG. 6, the first inner shielding connecting elements 55 and the second inner shielding connecting elements 65 are disposed inside the insulative carrier substrate 1, so that a height of the first radiator 51 relative to the common grounding metal layer 3 is greater than a height of the first inner shielding connecting element 55 relative to the common grounding metal layer 3, and a height of the second radiator 61 relative to the common grounding metal layer 3 is greater than a height of the second inner shielding connecting element 65 relative to the common grounding metal layer 3. However, the aforementioned details are disclosed for exemplary purposes only, and are not meant to limit the scope of the present disclosure.

Figure 7:
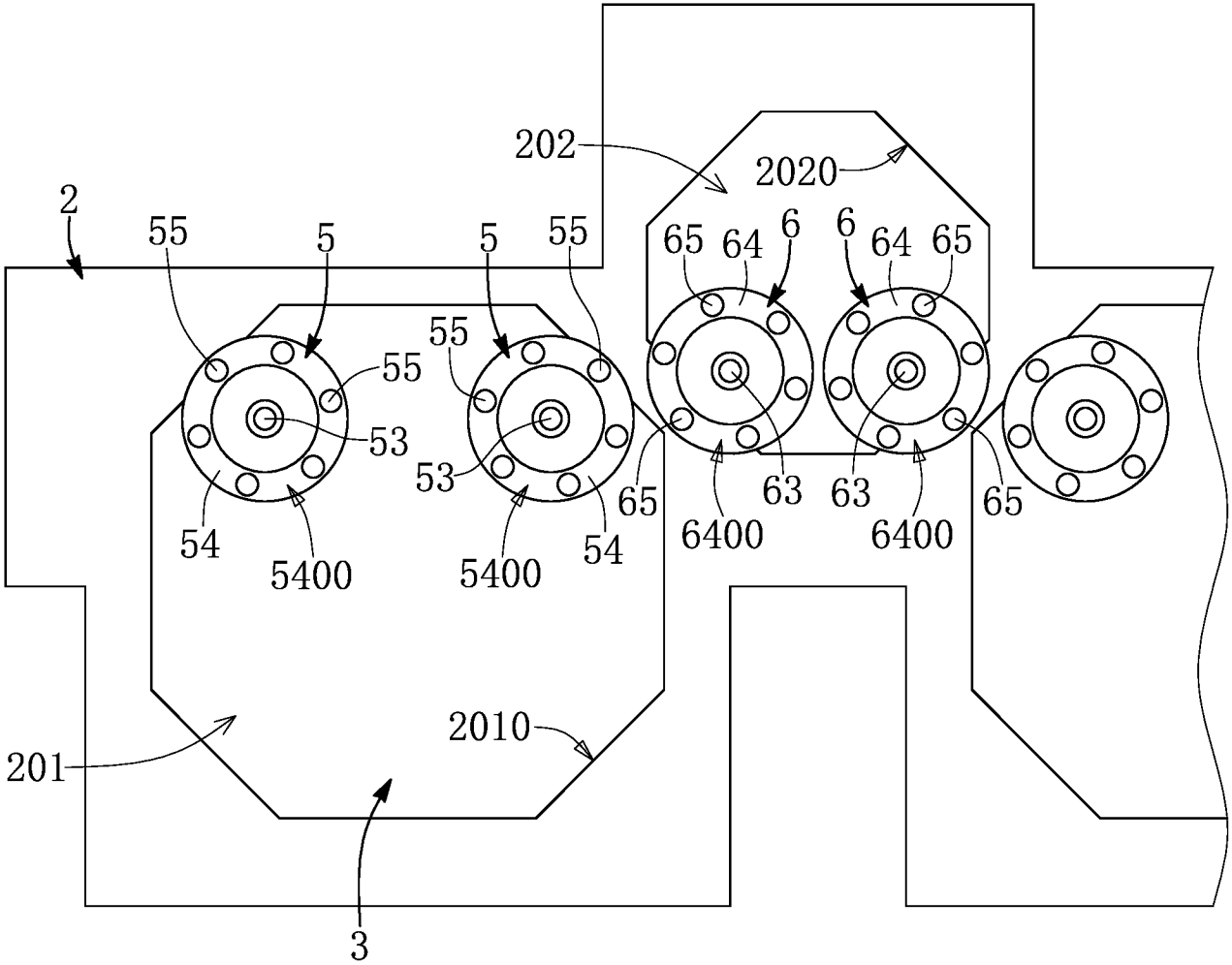
FIG. 7 is a partial schematic top view of the dual-band patch array antenna module after removing the insulative carrier substrate according to the first embodiment of the present disclosure.
Figure 8:
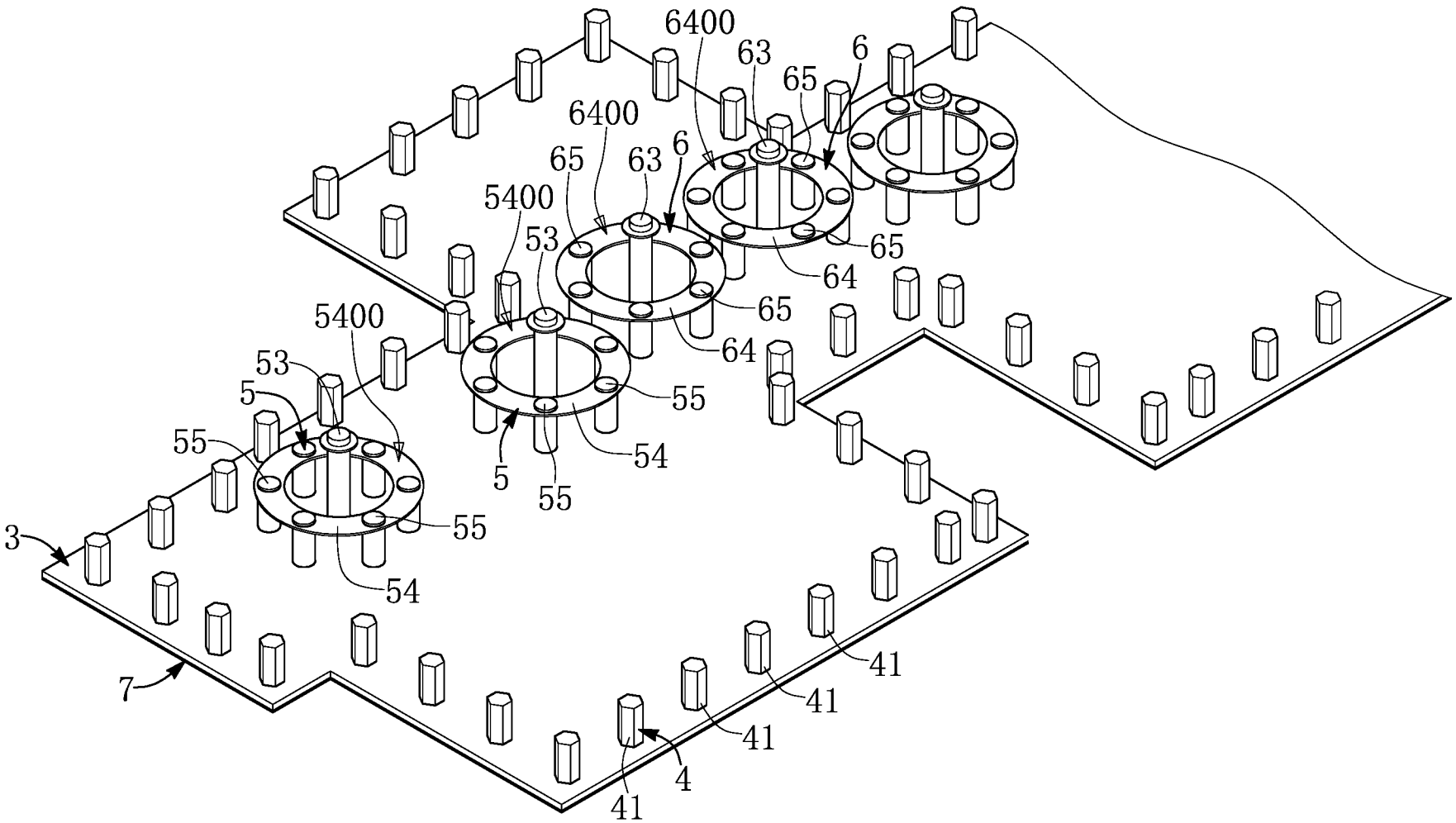
FIG. 8 is a partial schematic perspective view of the dual-band patch array antenna module after removing the insulative carrier substrate and a common conductive metal layer according to the first embodiment of the present disclosure.
Figure 9:
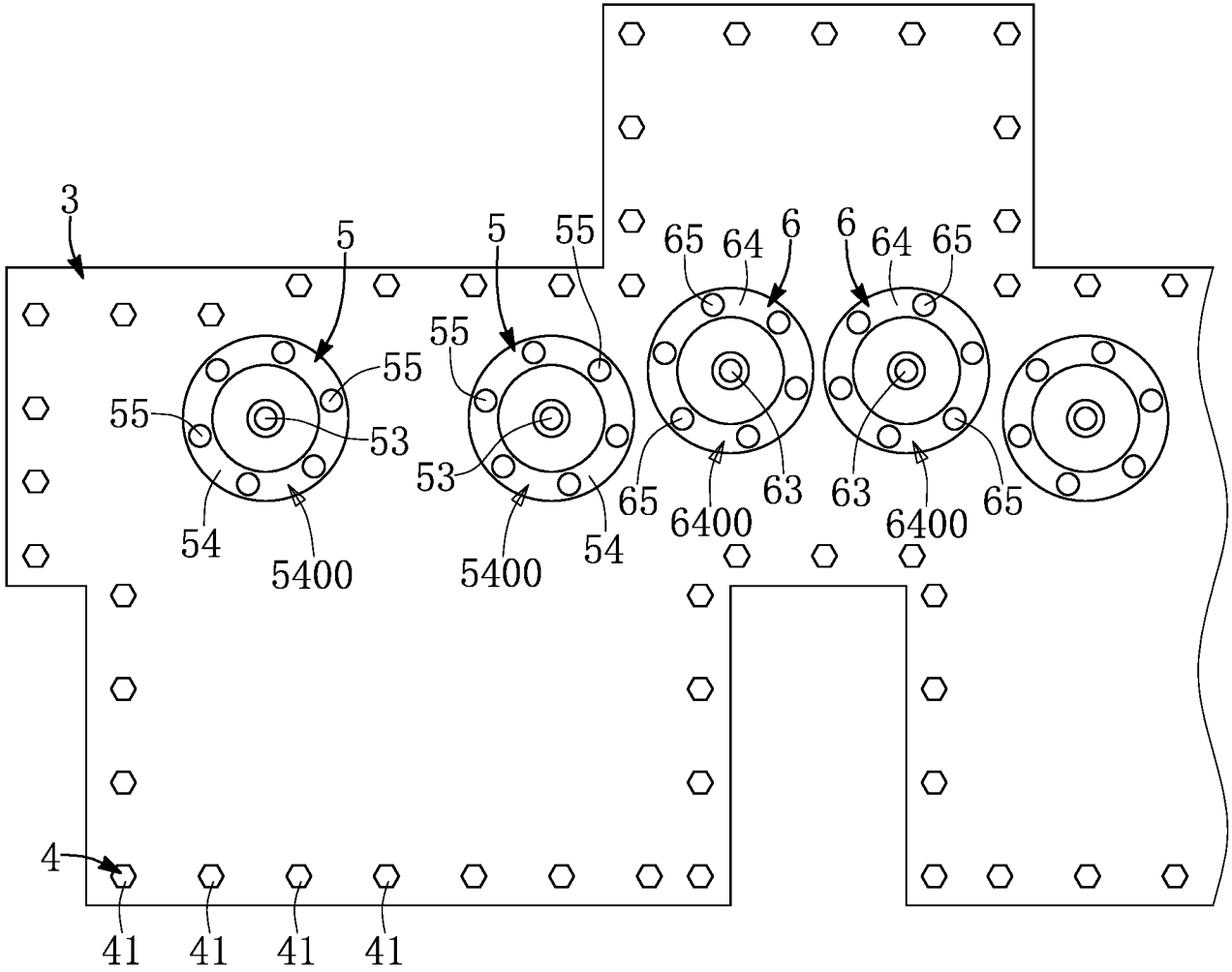
FIG. 9 is a partial schematic top view of the dual-band patch array antenna module after removing the insulative carrier substrate and the common conductive metal layer according to the first embodiment of the present disclosure.

For example, when the dual-band patch array antenna module M is configured for transmitting wireless signals, a wavelength of an operating frequency of the dual-band patch array antenna module M is λ, and an operating frequency of the first band antenna structure 5 is smaller than an operating frequency of the second band antenna structure 6. Firstly, as shown in FIG. 5, a distance from an outer peripheral surface of the insulative carrier substrate 1 to the first radiator 51 or the first metal element 52 can range between λ/4 and λ/2, and a distance from the outer peripheral surface of the insulative carrier substrate 1 to the second radiator 61 or the second metal element 62 can range between λ/4 and λ/2. In addition, referring to FIG. 5 and FIG. 7, a distance from an inner surface 2010 of the first through opening 201 to the first radiator 51 or the first metal element 52 can range between λ/4 and λ/2, and a distance from an inner surface 2020 of the second through opening 202 to the second radiator 61 or the second metal element 62 can range between λ/4 and λ/2. Moreover, as shown in FIG. 7, a distance from the first inner shielding connecting element 55 to the first feeding element 53 can range between λ/16 and λ/8, and a distance from the second inner shielding connecting element 65 to the second feeding element 63 can range between λ/16 and λ/8. Furthermore, referring to FIG. 7 and FIG. 9, a distance between two adjacent ones of the first inner shielding connecting elements 55 can range between λ/16 and λ/8, a distance between two adjacent ones of the second inner shielding connecting elements 65 can range between λ/16 and λ/8, and a distance between two adjacent ones of the outer shielding connecting elements 41 can range between λ/16 and λ/8. However, the aforementioned details are disclosed for exemplary purposes only, and are not meant to limit the scope of the present disclosure.

Figure 3:
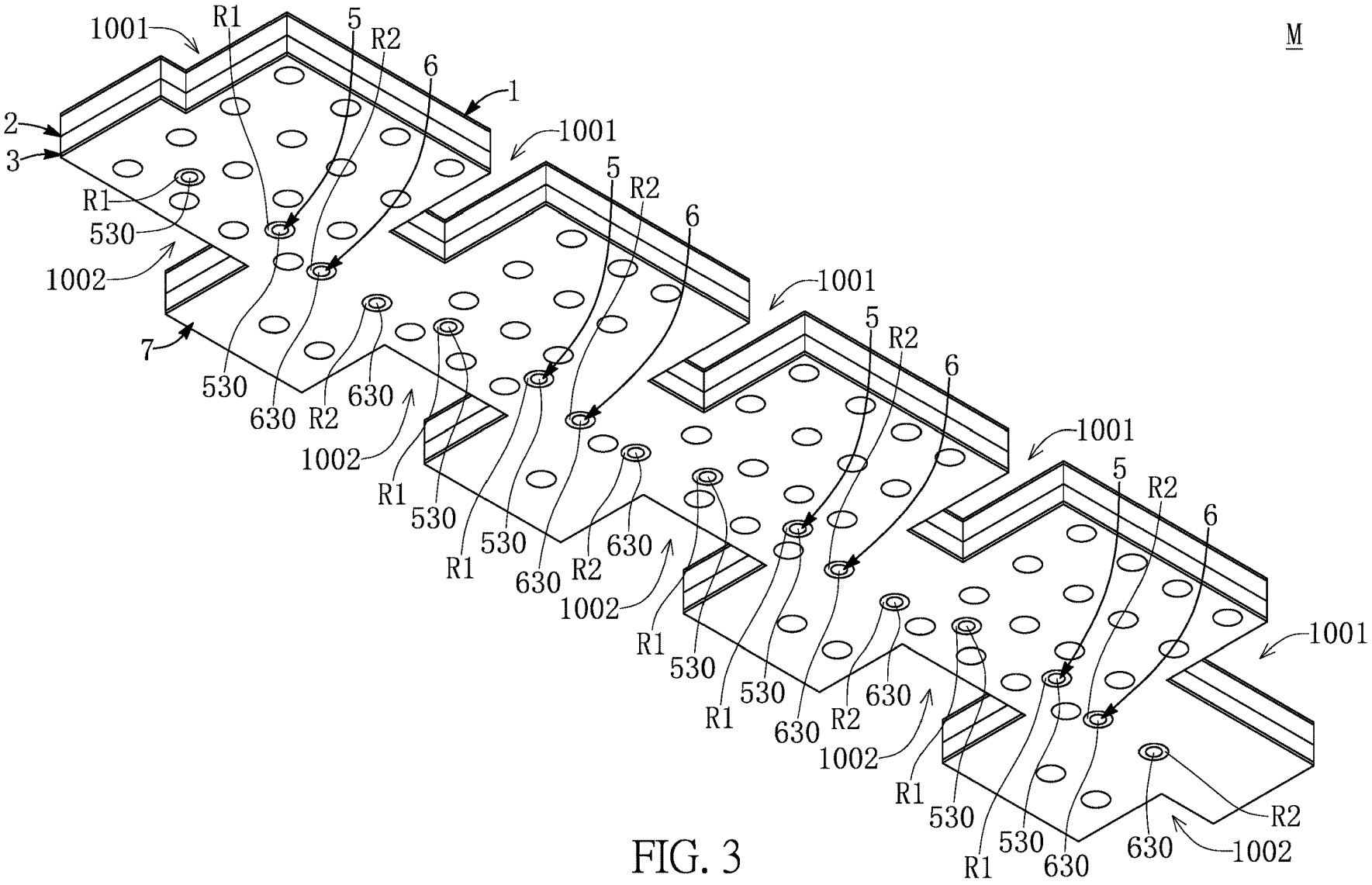
FIG. 3 is another schematic perspective view of the dual-band patch array antenna module according to the first embodiment of the present disclosure.
Figure 4:
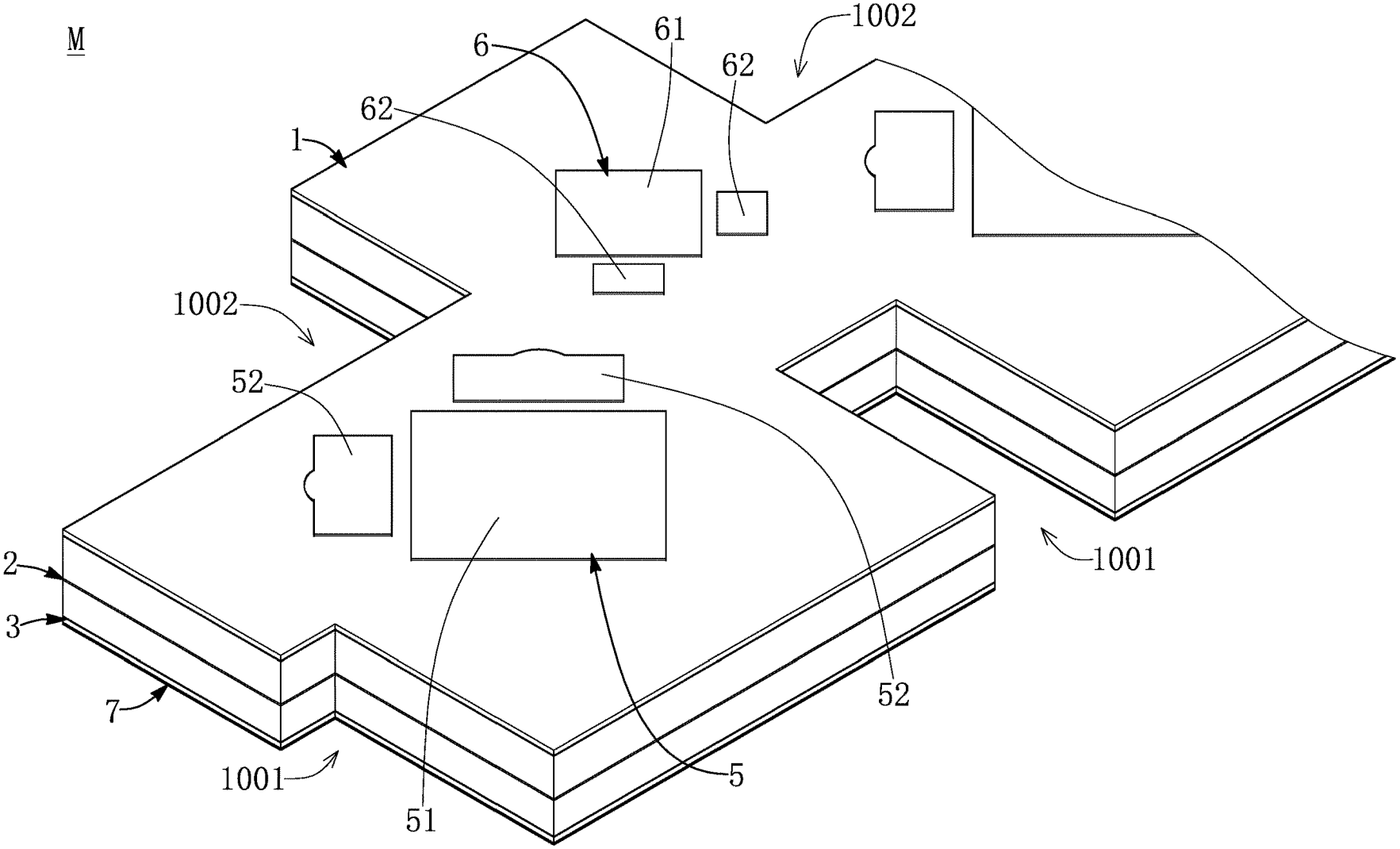
FIG. 4 is a partial schematic perspective view of the dual-band patch array antenna module according to the first embodiment of the present disclosure.

More particularly, referring to FIG. 1 and FIG. 3, the dual-band patch array antenna module M provided by the first embodiment of the present disclosure further includes a solder mask layer 7 (such as an insulative material layer) disposed on the common grounding metal layer 3. For example, there are many antenna solder pads (not labeled) that are exposed by the solder mask layer 7, each of the first feeding elements 53 has a first feeding portion 530 exposed outside the solder mask layer 7, and each of the second feeding elements 63 has a second feeding portion 630 exposed outside the solder mask layer 7. However, the aforementioned details are disclosed for exemplary purposes only, and are not meant to limit the scope of the present disclosure.

Second Embodiment

Figure 10:
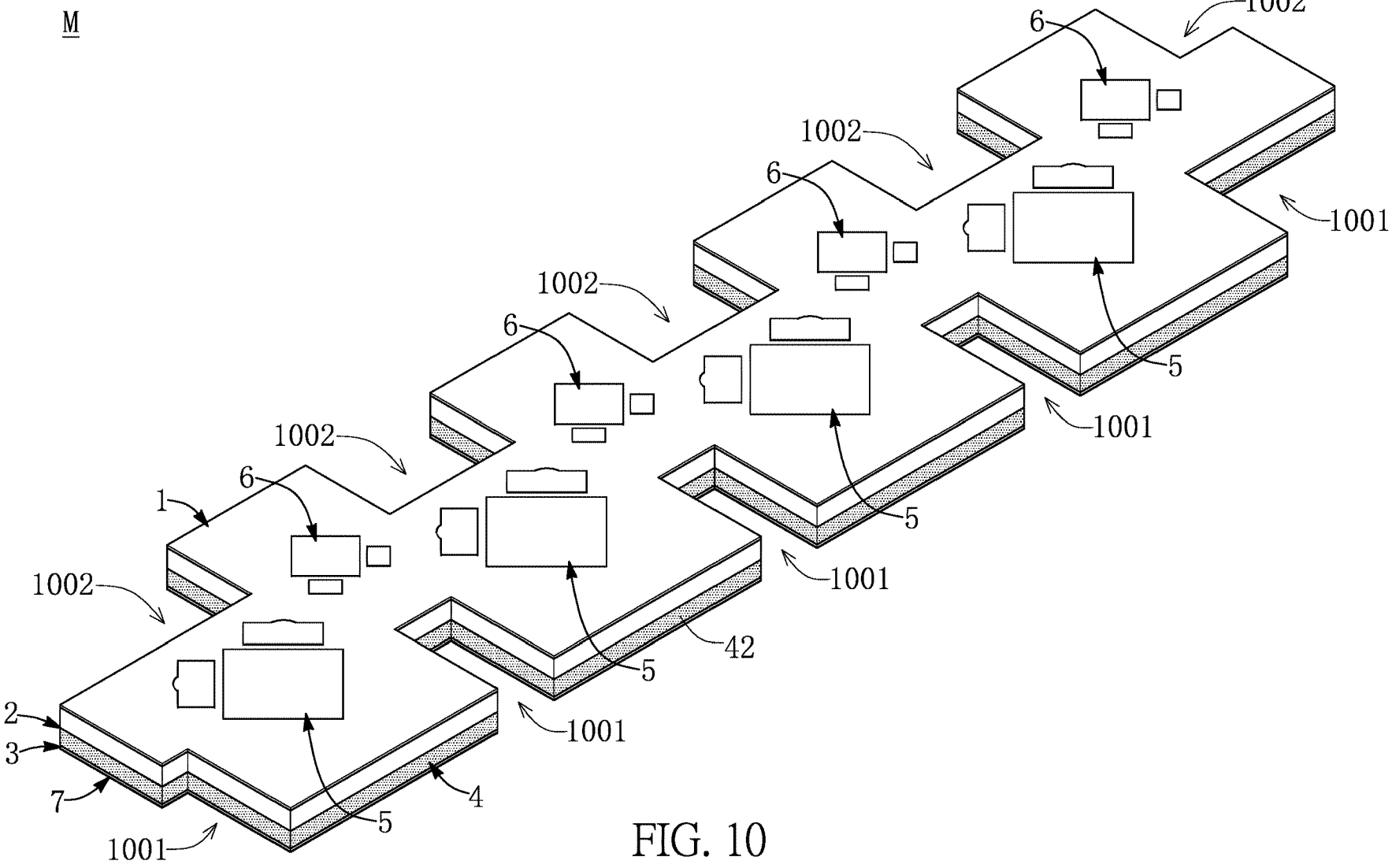
FIG. 10 is a schematic perspective view of the dual-band patch array antenna module according to a second embodiment of the present disclosure.
Figure 11:
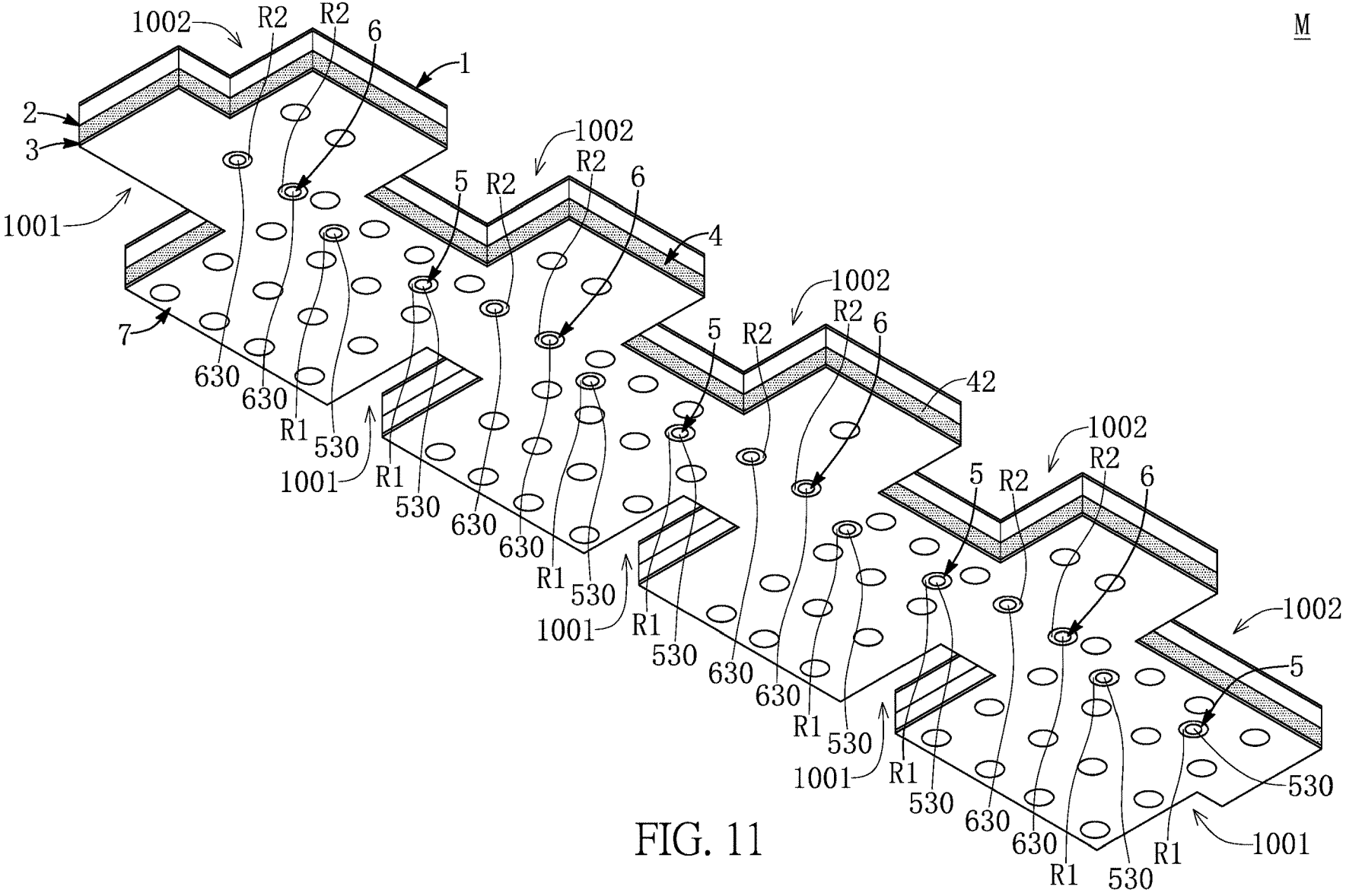
FIG. 11 is another schematic perspective view of the dual-band patch array antenna module according to the second embodiment of the present disclosure.

Referring to FIG. 10 and FIG. 11, a second embodiment of the present disclosure provides a dual-band patch array antenna module M, which includes an insulative carrier substrate 1, a common conductive metal layer 2, a common grounding metal layer 3, an outer surrounding shielding structure 4, a plurality of first band antenna structures 5, and a plurality of second band antenna structures 6. Comparing FIG. 10 with FIG. 1, and comparing FIG. 11 with FIG. 3, the main difference between the second embodiment and the first embodiment is as follows: in the second embodiment, the outer surrounding shielding structure 4 includes an outer surrounding shielding layer 42 disposed on the insulative carrier substrate 1. That is to say, the outer shielding connecting elements 41 of the first embodiment can be replaced by the outer surrounding shielding layer 42 of the second embodiment. In addition, the outer surrounding shielding layer 42 can surround the first band antenna structures 5 and the second band antenna structures 6, and the outer surrounding shielding layer 42 can be electrically connected between the common conductive metal layer 2 and the common grounding metal layer 3.

Third Embodiment

Figure 12:
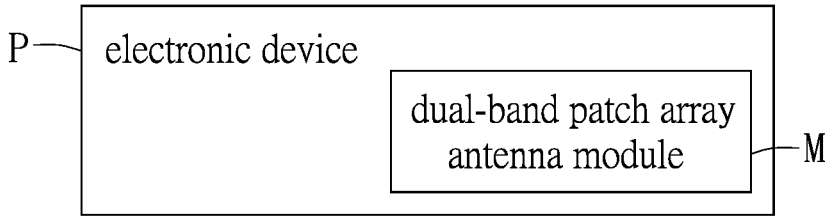
FIG. 12 is a functional block diagram of an electronic device using the dual-band patch array antenna module according to a third embodiment of the present disclosure.

Referring to FIG. 12, a third embodiment of the present disclosure provides an electronic device P using a dual-band patch array antenna module M, and the dual-band patch array antenna module M can be provided by the first embodiment or the second embodiment. It should be noted that the electronic device P can also be a movable device such as a vehicle.

Beneficial Effects of the Embodiments

In conclusion, in the dual-band patch array antenna module M and the electronic device P provided by the present disclosure, by virtue of "the common conductive metal layer 2 being disposed inside the insulative carrier substrate 1," "the common grounding metal layer 3 being disposed on a bottom side of the insulative carrier substrate 1," "the outer surrounding shielding structure 4 being electrically connected between the common conductive metal layer 2 and the common grounding metal layer 3," "each of the first band antenna structures 5 including a first radiator 51 disposed on the insulative carrier substrate 1, two first metal elements 52 adjacent to the first radiator 51, two first feeding elements 53 respectively electrically connected to the two first metal elements 52, and two first inner surrounding shielding assemblies respectively surrounding the two first feeding elements 53," and "each of the second band antenna structures 6 including a second radiator 61 disposed on the insulative carrier substrate 1, two second metal elements 62 adjacent to the second radiator 61, two second feeding elements 63 respectively electrically connected to the two second metal elements 62, and two second inner surrounding shielding assemblies respectively surrounding the two second feeding elements 63," an antenna isolation between the first band antenna structure 5 and the second band antenna structure 6 can be improved, so that an antenna mode provided by the dual-band patch array antenna module M can be cleared so as to obtain a clear antenna mode, and an antenna characteristic provided by the dual-band patch array antenna module M can be improved so as to obtain an optimal antenna performance.

The foregoing description of the exemplary embodiments of the disclosure has been presented only for the purposes of illustration and description and is not intended to be exhaustive or to limit the disclosure to the precise forms disclosed. Many modifications and variations are possible in light of the above teaching.

The embodiments were chosen and described in order to explain the principles of the disclosure and their practical application so as to enable others skilled in the art to utilize the disclosure and various embodiments and with various modifications as are suited to the particular use contemplated. Alternative embodiments will become apparent to those skilled in the art to which the present disclosure pertains without departing from its spirit and scope.

What is claimed is:

1. A dual-band patch array antenna module, comprising:

an insulative carrier substrate;

a common conductive metal layer disposed inside the insulative carrier substrate, wherein the common conductive metal layer has a plurality of first through openings and a plurality of second through openings;

a common grounding metal layer disposed on a bottom side of the insulative carrier substrate;

an outer surrounding shielding structure electrically connected between the common conductive metal layer and the common grounding metal layer;

a plurality of first band antenna structures, wherein each of the first band antenna structures includes a first radiator, two first metal elements, two first feeding elements, and two first inner surrounding shielding assemblies, the first radiator is disposed on the insulative carrier substrate, the two first metal elements are disposed on the insulative carrier substrate and adjacent to the first radiator, the two first feeding elements pass through the insulative carrier substrate and respectively electrically connect to the two first metal elements, and the two first inner surrounding shielding assemblies are disposed inside the insulative carrier substrate and respectively surround the two first feeding elements; and a plurality of second band antenna structures, wherein each of the second band antenna structures includes a second radiator, two second metal elements, two second feeding elements, and two second inner surrounding shielding assemblies, the second radiator is disposed on the insulative carrier substrate, the two second metal elements are disposed on the insulative carrier substrate and adjacent to the second radiator, the two second feeding elements pass through the insulative carrier substrate and respectively electrically connect to the two second metal elements, and the two second inner surrounding shielding assemblies are disposed inside the insulative carrier substrate and respectively surround the two second feeding elements;

wherein each of the first feeding elements is disposed between a corresponding one of the first metal elements and the common grounding metal layer, and separated from the common grounding metal layer through a first insulative ring, and each of the second feeding elements is disposed between a corresponding one of the second metal elements and the common grounding metal layer, and separated from the common grounding metal layer through a second insulative ring;

wherein each of the first inner surrounding shielding assemblies includes a first annular connecting element and a plurality of first inner shielding connecting elements, the first annular connecting element is electrically connected to the common conductive metal layer and surrounds a corresponding one of the first feeding elements, and the first inner shielding connecting elements are electrically connected between the first annular connecting element and the common grounding metal layer, and surround the corresponding one of the first feeding elements;

wherein each of the second inner surrounding shielding assemblies includes a second annular connecting element and a plurality of second inner shielding connecting elements, the second annular connecting element is electrically connected to the common conductive metal layer and surrounds a corresponding one of the second feeding elements, and the second inner shielding connecting elements are electrically connected between the second annular connecting element and the common grounding metal layer, and surround the corresponding one of the second feeding elements;

wherein the two first feeding elements of each of the first band antenna structures and the first inner shielding connecting elements respectively pass through the first through openings, and the two second feeding elements of each of the second band antenna structures and the second inner shielding connecting elements respectively pass through the second through openings.

2. The dual-band patch array antenna module according to claim 1, wherein the outer surrounding shielding structure includes a plurality of outer shielding connecting elements separate from each other and arranged in an annular shape, the outer shielding connecting elements surround the first band antenna structures and the second band antenna structures, and each of the outer shielding connecting elements is electrically connected between the common conductive metal layer and the common grounding metal layer.

3. The dual-band patch array antenna module according to claim 1, wherein the outer surrounding shielding structure includes an outer surrounding shielding layer disposed on the insulative carrier substrate, the outer surrounding shielding layer surrounds the first band antenna structures and the second band antenna structures, and the outer shielding connecting element is electrically connected between the common conductive metal layer and the common grounding metal layer.

4. The dual-band patch array antenna module according to claim 1, wherein the insulative carrier substrate has a plurality of first notches and a plurality of second notches, the first notches are recessed from a first lateral side of the insulative carrier substrate and respectively correspond to the second band antenna structures, and the second notches are recessed from a second lateral side of the insulative carrier substrate and respectively correspond to the first band antenna structures;

wherein the first band antenna structures are adjacent to the first lateral side of the insulative carrier substrate and arranged in a straight line, the second band antenna structures are adjacent to the second lateral side of the insulative carrier substrate and arranged in a straight line, and the first band antenna structures and the second band antenna structures are staggered with respect to each other;

wherein an outer contour of the common conductive metal layer is the same as an outer contour of the insulative carrier substrate, the common conductive metal layer, the first annular connecting element and the second annular connecting element have a same thickness, and a top surface of the common conductive metal layer, a top surface of the first annular connecting element and a top surface of the second annular connecting element are flush with each other;

wherein a height of the first radiator relative to the common grounding metal layer is greater than a height of the first inner shielding connecting element relative to the common grounding metal layer, and a height of the second radiator relative to the common grounding metal layer is greater than a height of the second inner shielding connecting element relative to the common grounding metal layer.

5. The dual-band patch array antenna module according to claim 1, further comprising: a solder mask layer disposed on the common grounding metal layer;

wherein each of the first feeding elements has a first feeding portion exposed outside the solder mask layer, and each of the second feeding elements has a second feeding portion exposed outside the solder mask layer;

wherein the outer surrounding shielding structure includes a plurality of outer shielding connecting elements separate from each other and arranged in an annular shape, the outer shielding connecting elements surround the first band antenna structures and the second band antenna structures, and each of the outer shielding connecting elements is electrically connected between the common conductive metal layer and the common grounding metal layer;

wherein an operating frequency of the first band antenna structure is smaller than an operating frequency of the second band antenna structure;

wherein, when the dual-band patch array antenna module is configured for transmitting wireless signals, a wavelength of an operating frequency of the dual-band patch array antenna module is $\lambda$;

wherein a distance from an outer peripheral surface of the insulative carrier substrate to the first radiator or the first metal element is within a range from $\lambda/4$ to $\lambda/2$, and a distance from the outer peripheral surface of the insulative carrier substrate to the second radiator or the second metal element is within a range from $\lambda/4$ to $\lambda/2$;

wherein a distance from an inner surface of the first through opening to the first radiator or the first metal element is within a range from $\lambda/4$ to $\lambda/2$, and a distance from an inner surface of the second through opening to the second radiator or the second metal element is within a range from $\lambda/4$ to $\lambda/2$;

wherein a distance from the first inner shielding connecting element to the first feeding element is within a range from $\lambda/16$ to $\lambda/8$, and a distance from the second inner shielding connecting element to the second feeding element is within a range from $\lambda/16$ to $\lambda/8$;

wherein a distance between two adjacent ones of the first inner shielding connecting elements is within a range from $\lambda/16$ to $\lambda/8$, a distance between two adjacent ones of the second inner shielding connecting elements is within a range from $\lambda/16$ to $\lambda/8$, and a distance between two adjacent ones of the outer shielding connecting elements is within a range from $\lambda/16$ to $\lambda/8$.

6. A dual-band patch array antenna module, comprising:

an insulative carrier substrate;

a common conductive metal layer disposed inside the insulative carrier substrate;

a common grounding metal layer disposed on a bottom side of the insulative carrier substrate;

an outer surrounding shielding structure electrically connected between the common conductive metal layer and the common grounding metal layer;

a plurality of first band antenna structures, wherein each of the first band antenna structures includes a first radiator disposed on the insulative carrier substrate, two first metal elements adjacent to the first radiator, two first feeding elements respectively electrically connected to the two first metal elements, and two first inner surrounding shielding assemblies respectively surrounding the two first feeding elements; and a plurality of second band antenna structures, wherein each of the second band antenna structures includes a second radiator disposed on the insulative carrier substrate, two second metal elements adjacent to the second radiator, two second feeding elements respectively electrically connected to the two second metal elements, and two second inner surrounding shielding assemblies respectively surrounding the two second feeding elements.

7. The dual-band patch array antenna module according to claim 6, wherein each of the first feeding elements is disposed between a corresponding one of the first metal elements and the common grounding metal layer, and separated from the common grounding metal layer through a first insulative ring, and each of the second feeding elements is disposed between a corresponding one of the second metal elements and the common grounding metal layer, and separated from the common grounding metal layer through a second insulative ring;

wherein each of the first inner surrounding shielding assemblies includes a first annular connecting element and a plurality of first inner shielding connecting elements, the first annular connecting element is electrically connected to the common conductive metal layer and surrounds a corresponding one of the first feeding elements, and the first inner shielding connecting elements are electrically connected between the first annular connecting element and the common grounding metal layer, and surround the corresponding one of the first feeding elements;

wherein each of the second inner surrounding shielding assemblies includes a second annular connecting element and a plurality of second inner shielding connecting elements, the second annular connecting element is electrically connected to the common conductive metal layer and surrounds a corresponding one of the second feeding elements, and the second inner shielding connecting elements are electrically connected between the second annular connecting element and the common grounding metal layer, and surround the corresponding one of the second feeding elements.

8. The dual-band patch array antenna module according to claim 7, wherein the insulative carrier substrate has a plurality of first notches and a plurality of second notches, the first notches are recessed from a first lateral side of the insulative carrier substrate and respectively correspond to the second band antenna structures, and the second notches are recessed from a second lateral side of the insulative carrier substrate and respectively correspond to the first band antenna structures;

wherein the first band antenna structures are adjacent to the first lateral side of the insulative carrier substrate and arranged in a straight line, the second band antenna structures are adjacent to the second lateral side of the insulative carrier substrate and arranged in a straight line, and the first band antenna structures and the second band antenna structures are staggered with respect to each other;

wherein an outer contour of the common conductive metal layer is the same as an outer contour of the insulative carrier substrate, the common conductive metal layer, the first annular connecting element and the second annular connecting element have a same thickness, and a top surface of the common conductive metal layer, a top surface of the first annular connecting element and a top surface of the second annular connecting element are flush with each other;

wherein a height of the first radiator relative to the common grounding metal layer is greater than a height of the first inner shielding connecting element relative to the common grounding metal layer, and a height of the second radiator relative to the common grounding metal layer is greater than a height of the second inner shielding connecting element relative to the common grounding metal layer.

9. An electronic device using a dual-band patch array antenna module, characterized in that the dual-band patch array antenna module comprises:

an insulative carrier substrate;

a common conductive metal layer disposed inside the insulative carrier substrate;

a common grounding metal layer disposed on a bottom side of the insulative carrier substrate;

an outer surrounding shielding structure electrically connected between the common conductive metal layer and the common grounding metal layer;

a plurality of first band antenna structures, wherein each of the first band antenna structures includes a first radiator disposed on the insulative carrier substrate, two first metal elements adjacent to the first radiator, two first feeding elements respectively electrically connected to the two first metal elements, and two first inner surrounding shielding assemblies respectively surrounding the two first feeding elements; and a plurality of second band antenna structures, wherein each of the second band antenna structures includes a second radiator disposed on the insulative carrier substrate, two second metal elements adjacent to the second radiator, two second feeding elements respectively electrically connected to the two second metal elements, and two second inner surrounding shielding assemblies respectively surrounding the two second feeding elements.

10. The electronic device according to claim 9, wherein each of the first feeding elements is disposed between a corresponding one of the first metal elements and the common grounding metal layer, and separated from the common grounding metal layer through a first insulative ring, and each of the second feeding elements is disposed between a corresponding one of the second metal elements and the common grounding metal layer, and separated from the common grounding metal layer through a second insulative ring;

wherein each of the first inner surrounding shielding assemblies includes a first annular connecting element and a plurality of first inner shielding connecting elements, the first annular connecting element is electrically connected to the common conductive metal layer and surrounds a corresponding one of the first feeding elements, and the first inner shielding connecting elements are electrically connected between the first annular connecting element and the common grounding metal layer, and surround the corresponding one of the first feeding elements;

wherein each of the second inner surrounding shielding assemblies includes a second annular connecting element and a plurality of second inner shielding connecting elements, the second annular connecting element is electrically connected to the common conductive metal layer and surrounds a corresponding one of the second feeding elements, and the second inner shielding connecting elements are electrically connected between the second annular connecting element and the common grounding metal layer, and surround the corresponding one of the second feeding elements;

wherein the insulative carrier substrate has a plurality of first notches and a plurality of second notches, the first notches are recessed from a first lateral side of the insulative carrier substrate and respectively correspond to the second band antenna structures, and the second notches are recessed from a second lateral side of the insulative carrier substrate and respectively correspond to the first band antenna structures;

wherein the first band antenna structures are adjacent to the first lateral side of the insulative carrier substrate and arranged in a straight line, the second band antenna structures are adjacent to the second lateral side of the insulative carrier substrate and arranged in a straight line, and the first band antenna structures and the second band antenna structures are staggered with respect to each other;

wherein an outer contour of the common conductive metal layer is the same as an outer contour of the insulative carrier substrate, the common conductive metal layer, the first annular connecting element and the second annular connecting element have a same thickness, and a top surface of the common conductive metal layer, a top surface of the first annular connecting element and a top surface of the second annular connecting element are flush with each other;

wherein a height of the first radiator relative to the common grounding metal layer is greater than a height of the first inner shielding connecting element relative to the common grounding metal layer, and a height of the second radiator relative to the common grounding metal layer is greater than a height of the second inner shielding connecting element relative to the common grounding metal layer.

* * * * *